United States Patent [19]

Frick

[11] Patent Number: 4,509,914

[45] Date of Patent: Apr. 9, 1985

[54] APPARATUS FOR THE COMBUSTION OF LIQUID FUELS IN THE GASEOUS STATE

[75] Inventor: Adolf Frick, Balzers, Liechtenstein

[73] Assignee: Stoechio-Matic AG, Schaan, Liechtenstein

[21] Appl. No.: 447,848

[22] Filed: Dec. 8, 1982

[30] Foreign Application Priority Data

Dec. 14, 1981 [CH] Switzerland ..... 7960/81

[51] Int. Cl.[3] ..... F23D 11/38

[52] U.S. Cl. ..... 431/121; 431/207; 431/38; 431/122

[58] Field of Search ..... 431/11, 12, 19, 38, 431/121, 122, 207, 208, 3; 236/15 C; 123/3, 179 H, 312; 48/180 H, 180 F, 103

[56] References Cited

U.S. PATENT DOCUMENTS

| | | | |
|---|---|---|---|
| 2,969,800 | 1/1961 | Skirvin et al. | 48/180 R |
| 4,265,613 | 5/1981 | Oppenberg | 431/121 |
| 4,270,561 | 6/1981 | Bjorklund | 431/121 X |
| 4,396,371 | 8/1983 | Lorenz et al. | 431/12 X |

FOREIGN PATENT DOCUMENTS

| | | | |
|---|---|---|---|
| 144357 | 11/1951 | Australia | 431/121 |
| 0036128 | 9/1981 | European Pat. Off. | 431/207 |
| 55-831 | 5/1979 | Japan | 431/207 |
| 460964 | 2/1937 | United Kingdom | 431/121 |

*Primary Examiner*—Margaret A. Focarino
*Attorney, Agent, or Firm*—Griffin, Branigan & Butler

[57] ABSTRACT

A method for the combustion of liquid fuels in the gaseous state comprising the steps of evaporating fuel in a gasification chamber and burning the gasified fuel after it leaves the gasification chamber with a controlled amount of air. This is controlled by the pressure in the gasification chamber in such a way that the correct stoichiometric relationship between fuel and air is not altered by factors such as temperature and viscosity of the liquid fuel. The invention includes the apparatus used to carry out the process, and, particularly, means (37) to adjust air supply control means (25) according to the pressure in the gasification chamber (21).

3 Claims, 3 Drawing Figures

APPARATUS FOR THE COMBUSTION OF LIQUID FUELS IN THE GASEOUS STATE

BACKGROUND OF THE INVENTION

This invention refers to a method for the combustion of liquid fuels in the gaseous state, and particularly of a method in which liquid fuel is evaporated by heat in a gasification chamber and the gasified fuel, after leaving the gasification chamber, is then burned with a controlled amount of air.

The U.S.-patent application Ser. No. 241,976, now U.S. Pat. No. 4,421,475, describes a burner in which liquid fuel is evaporated in the absence of air and then burned with a controlled amount of air. Evaporation takes place in a gasification chamber in which motor driven wiping means are provided to distribute the fuel and to prevent deposits on the walls. Preventing of deposits on the walls ensures proper gasification of the fuel. In operation pressurized fuel gas is generated which exits the gasification chamber through a nozzle and burns upon mixture with air supplied by a fan. Adjustable air control means, such as a flap, are provided to control the air supply. To obtain optimum efficiency the air supply should always be in an accurate relationship to the fuel supply. In other words, the stoichiometric relationship between air and fuel should be correct to provide for complete oxidation of the fuel. For this purpose a flap is set to correspond to a fixed burner capacity. This has the disadvantage that by a change of the viscosity of the liquid fuel more or less fuel is transported to the gasification chamber so that the burner will operate with a lack or an excess of oxygen. In either case efficiency is reduced, and in case of lack of oxygen the combustion gases have a high carbon monoxide and soot content, thus causing safety and environmental problems. Such problems may also occur when the burner is switched-off, because after standstill of the fan no air is supplied and the flame may continue to burn with an insufficient supply of oxygen as long as there is gaseous fuel under pressure in the gasification chamber, unless special means, such as a valve, are provided to prevent gasified fuel from leaving the gasification chamber after standstill.

Accordingly, an object of the embodiments of this invention is to provide a method which permits an automatic adjustment of the air supply in accordance with the amount of gasified fuel leaving the gasification chamber.

Another object of the embodiments of this invention is to provide a burner whose capacity can be altered during operation in accordance with the calorific requirements of the boiler or the like.

An advantage of the embodiments of this invention is the provision of a method and an apparatus which always provide for practically correct stoichiometric relationship between fuel and air over a wide range of burner capacities and independent from factors such as temperatures and viscosity of the liquid fuel, or a change in the rate with which the fuel pump pumps fuel into the gasification chamber. This provides for high efficiency and practically eliminates the generation of soot and carbon monoxide.

Another advantage of the embodiments of this invention is that the burner does not require additional valves for preventing gasified fuel from being burned after the burner motor is switched off.

SUMMARY

A method for the combustion of the liquids fuels in gasified form by gasifying the liquid fuel in a gasification chamber and then burning the fuel leaving the gasification chamber provides that the supply of air is controlled by the pressure in the gasification chamber. The higher the pressure is in the gasification chamber the more fuel exits said chamber and the more air is used to burn said fuel. On switching-off the burner the gasified fuel is sucked from the gasification chamber by means of a pump or a vacuum chamber. The pump used for sucking the gasified fuel from the gasification chamber is also used for pumping the liquid fuel during the operation of the burner. The apparatus for the combustion contains means, such as a spring-biassed pneumatic cylinder, connected to the gasification chamber, to operate the air supply control means according to the pressure in the gasification chamber. The fuel pump is also used to suck the gasified fuel from the gasification chamber when the burner is switched-off. The energy required for driving the pump after the drive motor is switched-off is provided by inertia.

BRIEF DESCRIPTION OF THE DRAWING

The foregoing and other objects, features, and advantages of the invention will be apparent from the following more particular description of preferred embodiments as illustrated in the accompanying drawing in which reference characters refer to the same parts throughout the various views. The drawing is not necessarily to scale, emphasis instead being placed upon illustrating the principles of the invention.

DETAILED DESCRIPTION OF THE DRAWING

Figure 1:
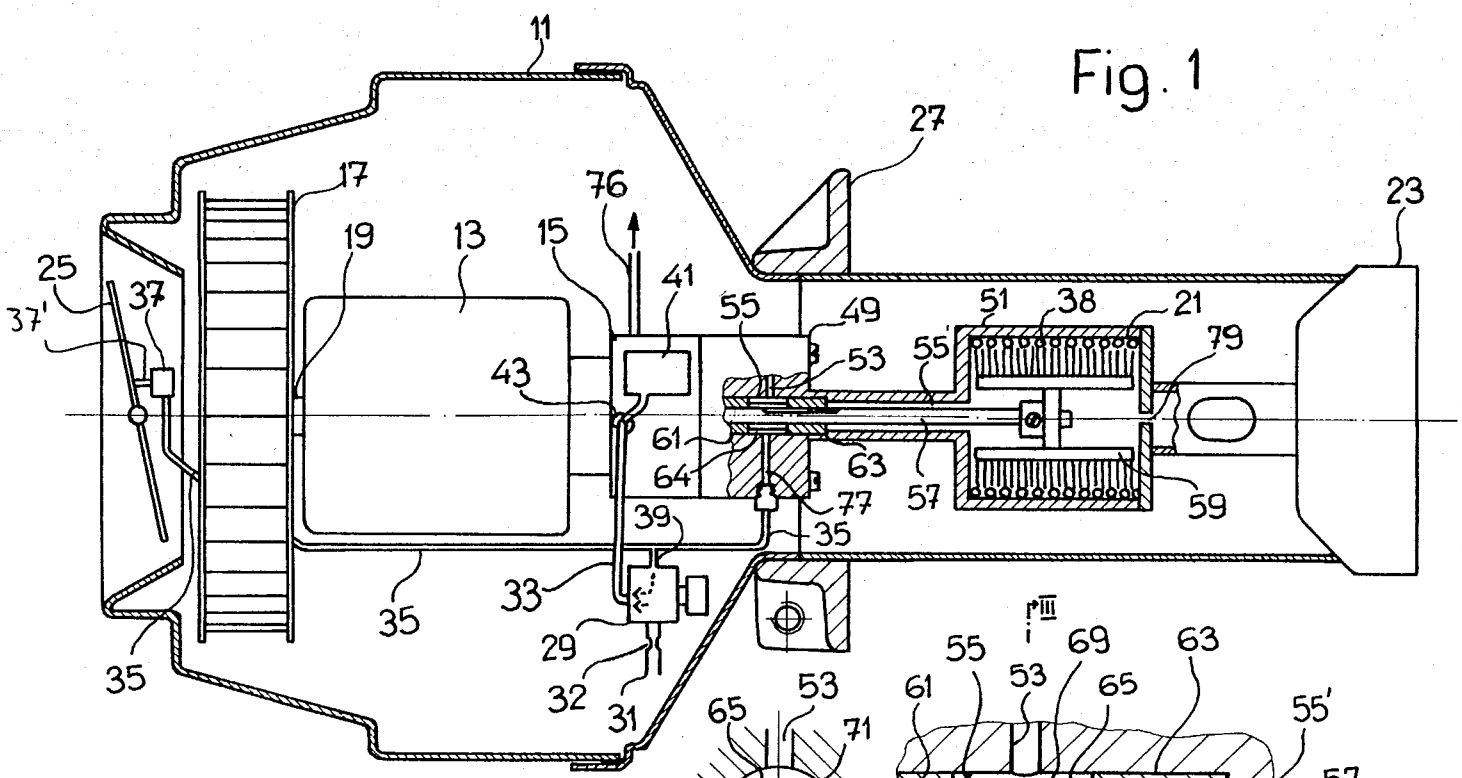
FIG. 1 is a cross-sectional view showing a burner according to a preferred embodiment of the invention.

A burner comprises a motor 13 to which are connected at the frontside a fuel pump 15 and at the backside a fan 17. Both fuel pump 15 and fan 17 are driven by a shaft 19. The gasification chamber 21 is located at the fuel pump 15. Connected to the gasification chamber 21 is a flame pot 23. Located near the fan 17 is a flap 25. A flange 27 is used for mounting the burner to a boiler or the like. Not shown in FIG. 1 are further elements such as ignition electrodes, ignition transformer and the like, not being necessary for the understanding of the present invention.

Schematically shown in the drawing is an electromagnetic valve 29 which, in operation of the burner, permits the flow of fuel from suction line 31 through a choke 32 to the fuel pump 15. The choke 32 is used to provide an underpressure. The choke 32 may also be a part of the electromagnetic valve 29. A fuel line 33 connecting the valve 29 with the fuel pump 15 is generally not necessary, because the valve 29 is preferably located directly on the fuel pump 15, instead, as shown schematically on the drawing, at a distance thereof. A channel 55 to the gasification chamber 21 is connected by a line 35 to an actuating member 37 of the flap 25, which acts as air supply control means. The lines 31, 33, 35, 76 may consist of copper tubing or the like. Actuating member 37 may be a spring-biased pneumatic cylinder. Accordingly, the higher the pressure acting on said cylinder the more the flap 25 will be opened, whereas, when no pressure is present, the spring will restore plunger 37' so that the flap 25 closes. The pressure in the gasification chamber 21 is caused by fuel evaporated by an electric heating means 38. This pressure is acting through the line 35 on the actuating member 37 to set the flap 25 in accordance to the pressure in the gasification chamber 21. A branch line 39 connects the line 35 also with valve 29 to permit, on switching-off the burner, removal of liquid and gaseous fuel from the gasification chamber 21. A vacuum chamber 41 together with pump 15 provide suction power when the burner is switched-off, because at that time also the valve 29 is switched to provide a suction force to draw fuel from the gasification chamber. It would also be possible to have the vacuum chamber 41 acting alone. A vacuum chamber has the advantage that it provides for a particularly fast pressure reduction in the gasification chamber. The vacuum chamber 41 is connected to a suction side of the pump; and 15 so that during operation of the pump an underpressure is created in the vacuum chamber. In the drawing the vacuum chamber 41 is shown schematically as a separate unit. In a preferred embodiment vacuum chamber 41 is located in the housing of the pump 15.

The usual fuel pump of the burner may be used as pump 15 for evacuation of the gasification chamber 41. For the embodiment shown a gear pump of the type "Fuel Master" with trochoid gearing, as manufactured by the Fuel Master Manufacturing Company, Rijswijk Z.H., Holland, has been used. A number of modifications have been made at the housing of the commercialy available pump. For example, the pump housing 49 also forms a part 51 of the housing of the gasification chamber 21. The output 53 of the pump 15 leads to a central bore 55 in the housing 49 to connect the fuel pump 15 with the gasification chamber 21. The bore 55 also receives a drive shaft 57 for wiping means 59 located in the gasification chamber 21. In addition, the bore 55 also serves to suck gasified fuel from the gasification chamber when the burner is switched-off. This has the advantage that liquid fuel and gasified fuel are mixed so that the gasified fuel condenses quickly.

Figure 2:
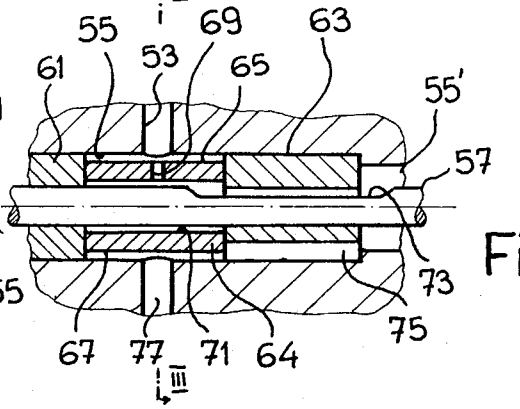
FIG. 2 is an enlarged view of the bearing section of the shaft for the wiping means.
Figure 3:
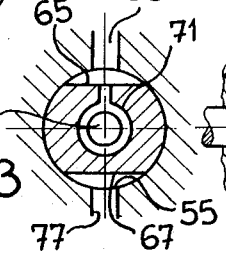
FIG. 3 shows a cross-sectional view along the line III—III of FIG. 2.

As may be best seen from the enlarged representation of FIGS. 2 and 3 shaft 57 is supported by two bearings 61, 63 in the bore 55. Between these bearings 61, 63 a bushing 64 is located. Bushing 64 has flat portions 65, 67 at the top and at the bottom to provide passages for fuel. An opening 69 permits the flow of fuel from the hole 71 of the bushing 64. Because the shaft 57 has a recess 73 fuel can flow through the narrowed portion 55' of the bore 55 to the gasification chamber 21 when the burner is in operation.

The bearing 63 has at the bottom a recess 75 permitting, when suction is applied, the flow of liquid and gaseous fuel to the duct 77 and from there through the lines 35, 39 to the valve 29 and back to the pump 15.

In operation of the burner the motor 13 drives the fan 17, the fuel pump 15, and the wiper 59. The fuel pump 15 sucks fuel from the fuel tank (not shown) through the line 31, the valve 29, and the line 33, and pumps a part of this fuel through the pump outlet 53 and the bore 55' into the gasification chamber 21. Another part of the fuel is pumped back through the line 76 into the fuel tank. As can be seen best from FIG. 2 the path of the fuel from the outlet 53 leads into the bore 69. Because of the recess 73 fuel can flow through the bearing 63 into the parts 55' of the bore 55 and then into the gasification chamber 21. The fuel evaporating in the gasification chamber under the heat of heating means 38 generates a pressure in the gasification chamber 21 causing the gasified fuel to flow out of a nozzle 79. After leaving the nozzle 79 the gasified fuel is burned together with air supplied by the fan 17. It burns with a blue flame emerging from the flame pot 23. The pressure in the gasification chamber 21 acts over the bores 55', 55, 77 and the line 35 onto the actuating member 37. The higher the pressure is on the actuating member 37, the more it opens the flap 25 against the bias of a spring (not shown). In this way the relation between the rate of gasified fuel and the rate of supplied air flowing to produce a flame is held practically constant over the whole capacity range of the burner, thus always maintaining the correct stoichiometric relationship between fuel and air. The rate of fuel supplied, and therefore of heat generated, can be adjusted by adjusting the pumping rate of the fuel pump.

When the burner motor 13 is switched-off the valve 29 is also switched. Because of the inertial masses of the motor armature and the fan 17, the pump does not immediately stop working, so that the input 43 of the fuel pump 15 still causes suction. However, because the valve 29 has switched, pump 15 is not acting on the suction line 31, but on the branch line 39, and therefore on the line 35. With suction being present on the line 35 the actuating member 37 closes the flap 25. This prevents further airflow through the burner which could cause a cooling of the boiler or the like. Suction is further applied on the bore 77 connected to the line 35. Therefore liquid and gaseous fuel is sucked from the central bore 55 and the gasification chamber 21. Accordingly, the pressure drops quickly in the gasification chamber 21, so that the flame extinguishes rapidly. Therefore unlike prior art devices no valve is needed to interrupt the flow of the gaseous fuel from the gasification chamber 21.

When the pump 15 sucks fuel from the bore 55 it also supplies fuel to the outlet 53. The cold liquid fuel from the pump 15 is thereby mixed with the hot gasified fuel from the gasification chamber 21, thus causing the gasified fuel to condense quickly. In addition, the liquid fuel provides cooling for the bearing 63, because the fuel flows from the outlet 53 through the bore 69, along the recess 73 through the bearing 63 and then back through the channel 75 to the bore 77.

In the embodiment shown not only the pump 15 causes suction, but also the vacuum chamber 41. The underpressure in the vacuum chamber 41 is caused when the burner is switched-on and the pump 15 is operating, because the fuel must flow through the choke 32. After switching-off of the burner and the switching of the valve 29 the underpressure is acting on the branch line 39, as has been described previously. Such a vacuum chamber 41 may therefore be used instead of a pump or in addition to a pump 15 for lowering pressure in the gasification chamber 21.

While the invention has been particularly shown and described with reference to the preferred embodiments thereof, it will be understood by those skilled in the art that various alterations in form and detail may be made therein without departing from the spirit and scope of the invention. For example, suction means other than a pump or a vacuum chamber, e.g. a piston in a cylinder, may be used. Further, instead of having the pressure of the gasification chamber 21 acting directly on the actuating member 37, a pressure sensor could be provided to create an electric signal for the control of an electric actuating member for setting the flap 25.

The embodiments of the invention in which exclusive property of privilege is claimed are defined as follows:

1. An apparatus for preventing the discharge of gasified fuel from an output nozzle of a gasification chamber of a fuel burning burner when said burner is switched off, comprising:

(a) a gasification chamber;

(b) heating means proximate said gasification chamber for gasifying liquid fuel in said gasification chamber;

(c) means for communicating liquid fuel to a first port of said gasification chamber;

(d) pump means having an input port selectively connectable to a second port of said gasification chamber and to a source of liquid fuel; and, (e) valve means for selectively terminating the supply of liquid fuel to said pump means and connecting said second port of said gasification chamber to said input port of said pump, thereby sucking said gasified fuel from said gasification chamber.

2. An apparatus as recited in claim 1, further including a vacuum chamber for receiving said fuel sucked from said gasification chamber.

3. An apparatus as recited in claim 2, further comprising:

means for combining liquid fuel with said gasified fuel to facilitate the condensation of said gasified fuel.

* * * * *